US006628185B2

(12) United States Patent
Raabe et al.

(10) Patent No.: US 6,628,185 B2
(45) Date of Patent: Sep. 30, 2003

(54) BLADE ASSEMBLY FOR A CIRCUIT BREAKER

(75) Inventors: Rodney Raabe, Cedar Rapids, IA (US); Jason Colsch, Cedar Rapids, IA (US); Laurent L. Previeux, Grenoble (FR)

(73) Assignee: Square D Company, Palatine, IL (US)

( * ) Notice: Subject to any disclaimer, the term of this patent is extended or adjusted under 35 U.S.C. 154(b) by 132 days.

(21) Appl. No.: 09/953,630

(22) Filed: Sep. 14, 2001

(65) Prior Publication Data

US 2003/0052758 A1 Mar. 20, 2003

(51) Int. Cl.[7] ..... H01H 9/00

(52) U.S. Cl. ..... 335/172; 335/168; 335/171; 335/128

(58) Field of Search ..... 218/22; 335/16

(56) References Cited

U.S. PATENT DOCUMENTS

| | | | | |
|---|---|---|---|---|
| 4,144,513 A | * | 3/1979 | Shaffer et al. | 335/46 |
| 4,431,877 A | | 2/1984 | Heft et al. | 200/144 |
| 4,635,011 A | | 1/1987 | Leone et al. | 335/16 |
| 4,644,307 A | | 2/1987 | Tanimoto | 335/16 |
| 4,716,265 A | | 12/1987 | Fujii et al. | 200/144 |
| 4,791,393 A | | 12/1988 | Flick et al. | 335/16 |

(List continued on next page.)

FOREIGN PATENT DOCUMENTS

| | | | |
|---|---|---|---|
| DE | 2128633 | 1/1973 | H01H/77/10 |
| DE | 4404706 A1 | 9/1994 | H01H/77/10 |

(List continued on next page.)

OTHER PUBLICATIONS

Description of Terasaki Circuit Breaker—Te21–43, as early as 1995, 1 page.

(List continued on next page.)

*Primary Examiner*—Elvin Enad
*Assistant Examiner*—Bernard Rojas
(74) *Attorney, Agent, or Firm*—Larry I. Golden

(57) ABSTRACT

A circuit breaker for interrupting the flow of current upon the detection of excess current or temperature is provided that has a current conducting blade mounted on a blade cross bar, which has a blade biasing spring for urging the blade to a first pivotal position on the blade cross bar during the open, closed, and tripped operation of the breaker, and for latching the blade in a second pivotal position on the blade cross bar upon the occurrence of a blown-open action of the breaker. The spring is a torsion spring that is coiled around a spring mounting pin, having a first end leg extending outwardly and formed into a hook anchored in a hook accommodating opening, and having a second end leg extending outwardly and cantilevered in contact with a spring follower pin. The second end of this leg is bent away from the spring follower pin to reduce the spring force exerted between the blade cross bar and the blade upon the occurrence of a blow-open action of the circuit breaker. Attached to the blade is a blade pivot pin that is generally cylindrical and that has a center section of reduced diameter establishing shoulders on the pin on both sides of a hole in the blade, so that upon application of force on the blade by the spring, the blade pivot pin is locked against displacement from the hole. On the blade cross bar a barrier is provided so positioned that upon pivoting movement of the blade cross bar to a tripped, open, or blown-open position, the barrier is interposed between the spring and the fixed contact, thereby protecting the spring from debris generated in the vicinity of the fixed contact.

8 Claims, 7 Drawing Sheets

U.S. PATENT DOCUMENTS

| | | | | |
|---|---|---|---|---|
| 4,841,266 | A | 6/1989 | Wulff | 335/16 |
| 5,220,488 | A | 6/1993 | Denes | 361/398 |
| 5,363,076 | A | * 11/1994 | Miller et al. | 335/16 |
| 5,440,284 | A | 8/1995 | Ferullo et al. | 355/202 |
| 5,466,903 | A | * 11/1995 | Faber et al. | 200/400 |
| 5,793,270 | A | 8/1998 | Beck et al. | 335/16 |
| 5,831,501 | A | * 11/1998 | Kolberg et al. | 335/42 |
| 5,910,760 | A | 6/1999 | Malingowski et al. | 335/167 |
| 5,926,081 | A | 7/1999 | DiMarco et al. | 335/16 |
| 5,994,988 | A | * 11/1999 | Ferree et al. | 335/190 |

FOREIGN PATENT DOCUMENTS

| | | | |
|---|---|---|---|
| EP | 0772195 A2 | 11/1996 | G11B/21/12 |
| JP | 04-280026 | 10/1992 | H01H/71/12 |
| JP | 09-161641 | 6/1997 | H01H/73/02 |
| JP | 2000-003655 | 1/2000 | H01H/71/74 |
| WO | WO 01/16986 A1 | 3/2001 | H01H/71/50 |

OTHER PUBLICATIONS

Description of Fuji Circuit Breaker—F–9–11, as early as 1995, 2 pages.

Description of Mitsubishi Circuit Breaker—M–21–6, as early as 1995, 2 pages.

Description of Toshiba Circuit Breaker—T–9–2, as early as 1995, 1 page.

Patent Abstract for Germany—DE 4404706 A, 1 page. (see B03).

Patent Abstracts for Japan—Publ. No. 04–280026, Oct. 6, 1992, 1 page. (see B04).

Patent Abstracts for Japan—Publ. No. 2000–003655, Jan. 7, 2000, 1 page. (see B06).

Patent Abstract for Japan—JP 9161641 A, 1 page. (see B05).

Photographs of Terasaki Circuit Breaker—Te21–43, Photographs 1–11, 11 pages.

Photographs of Fuji Circuit Breaker—F–9–11, Photographs 12–29, 18 pages.

Photographs of Mitsubishi Circuit Breaker—M–21–6, Photographs 30–48, 19 pages.

Photographs of Toshiba Circuit Breaker—T–9–2, Photographs 49–61, 13 pages.

* cited by examiner

BLADE ASSEMBLY FOR A CIRCUIT BREAKER

FIELD OF THE INVENTION

This invention is directed generally to circuit breakers and, more specifically, to a circuit breaker that has a blade assembly in which a torsion spring acts both as a contact pressure point, providing the required pressure to the blade to maintain a closed position, and as a latch, preventing the blade from closing after a short circuit interruption has occurred.

BACKGROUND OF THE INVENTION

Circuit breakers are used to provide circuit protection for low voltage distribution systems. Electrical circuits or electrical systems are protected by circuit breakers from electrical overcurrent conditions, such as overload conditions as well as low and high level short circuit or fault current conditions.

One component that contributes to the successful interruption of the circuit breaker when undesired overcurrent conditions occur is a blade. The blade is subjected to a resisting force which typically is preset to allow the blade to open only when certain conditions are met, i.e., when the current passing through the circuit breaker is above a particular threshold. This resisting force is generally provided by a blade spring. The blade spring may also be used, generally in combination with some other member such as a pin, to provide a latching mechanism that prevents the blade from reaching a closed position without the knowledge of a circuit breaker operator.

However, one of the disadvantages of the prior art devices is that, generally, more than one component is required to create a successful latching mechanism. For example, a prior art device uses a blade spring-pin combination wherein the spring and the pin work in unison to provide a latch that will retain the blade in its blown-open position. As the blade of that device rotates the pin translates along one arm of the blade spring, and acts as a barrier for the blade when the blade attempts to return to its closed position.

Another disadvantage of prior art devices is that the blade spring requires, in general, another component to secure the blade spring to a blade frame. Similarly, a blade pin on which the blade can freely rotate requires additional components to secure the blade pin in its position.

Another disadvantage of prior art devices is that in order to protect the blade spring complicated blade shields are attached. The blade shields add extra components and extra assembly steps in assembly.

Accordingly, it is an object of this invention to use a blade spring that can perform the latching feature of the blade and that can secure itself to the blade structure without the use of additional components.

It is another object of this invention to integrate a shield into the blade housing that will protect the blade springs from debris caused by arcing.

It is yet another object of this invention to use a blade pin that is self-retaining.

SUMMARY OF THE INVENTION

In accordance with a preferred embodiment of the invention, a circuit breaker for interrupting the flow of current upon the detection of excess current or temperature is provided which has a frame having mounted thereon a fixed contact and conductors for establishing an interruptible current flow path through the fixed contact. A blade cross bar is mounted on the frame for pivoting movement about a blade cross bar axis. The blade cross bar has a current conducting blade mounted for pivoting movement thereon about a blade axis which is preferably radially offset from the blade cross bar. The blade has a moveable contact thereon for engaging and disengaging the fixed contact. The blade cross bar has a blade biasing spring for urging the blade to a first pivotal position on the blade cross bar during the open, closed, and tripped operation of the breaker, and for latching the blade in a second pivotal position on the blade cross bar upon the occurrence of a blow-open action of the breaker.

A spring mounting pin is preferably provided on the blade cross bar parallel to and offset from the blade cross bar axis. A spring follower pin is mounted on the blade parallel to and offset from the blade pivot axis. A hook-accommodating opening is formed on the blade cross bar. A blade bias spring is provided which is a coiled torsion spring coiled around the spring mounting pin and having a first end leg extending outwardly and formed into a hook anchored in said hook accommodating opening, and further having a second end leg extending outwardly and cantilevered into contact with the spring follower pin. The second end of this leg is bent away from the spring follower pin to reduce the spring force exerted between the blade cross bar and the blade upon the occurrence of a blown-open action of the circuit breaker. A mounting hole in the blade positioned on the blade axis is preferably provided, together with a blade pivot pin passing through the hole for mounting the blade. The blade pivot pin is generally cylindrical and has a center section of reduced diameter establishing shoulders on the pin on both sides of the hole in the blade, so that upon application of force on the blade by the spring, the blade pivot pin is locked against displacement from the hole. It is further preferred to provide a barrier on the blade cross bar so positioned that upon pivoting movement of the blade cross bar to a tripped, open, or blown-open position, the barrier is interposed between the spring and the fixed contact, thereby protecting the spring from debris generated in the vicinity of the fixed contact.

DETAILED DESCRIPTION OF THE ILLUSTRATED EMBODIMENT

Figure 1:
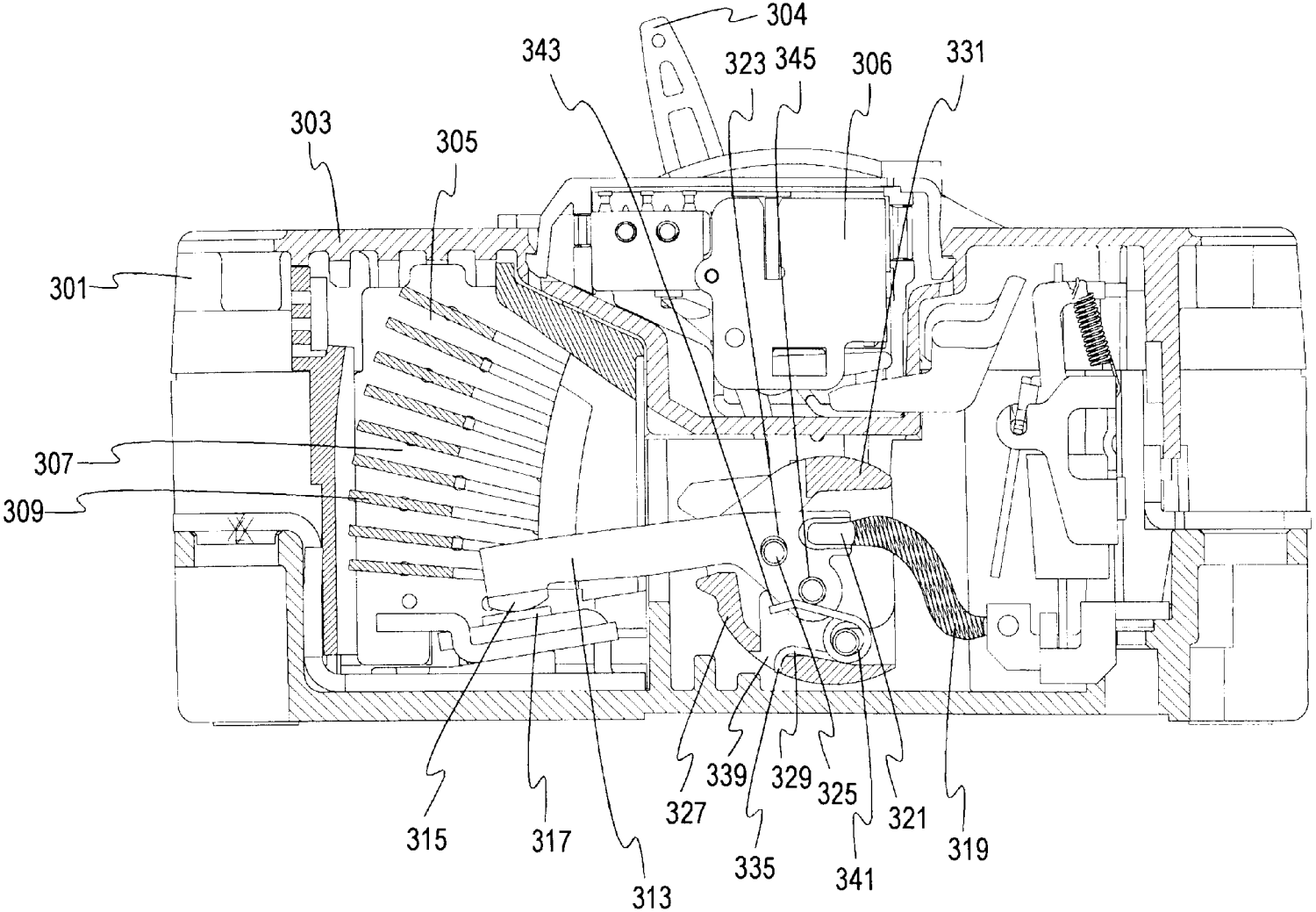
FIG. 1 is a cross-sectional view of a circuit breaker embodying the present invention, shown in the closed position.
Figure 2:
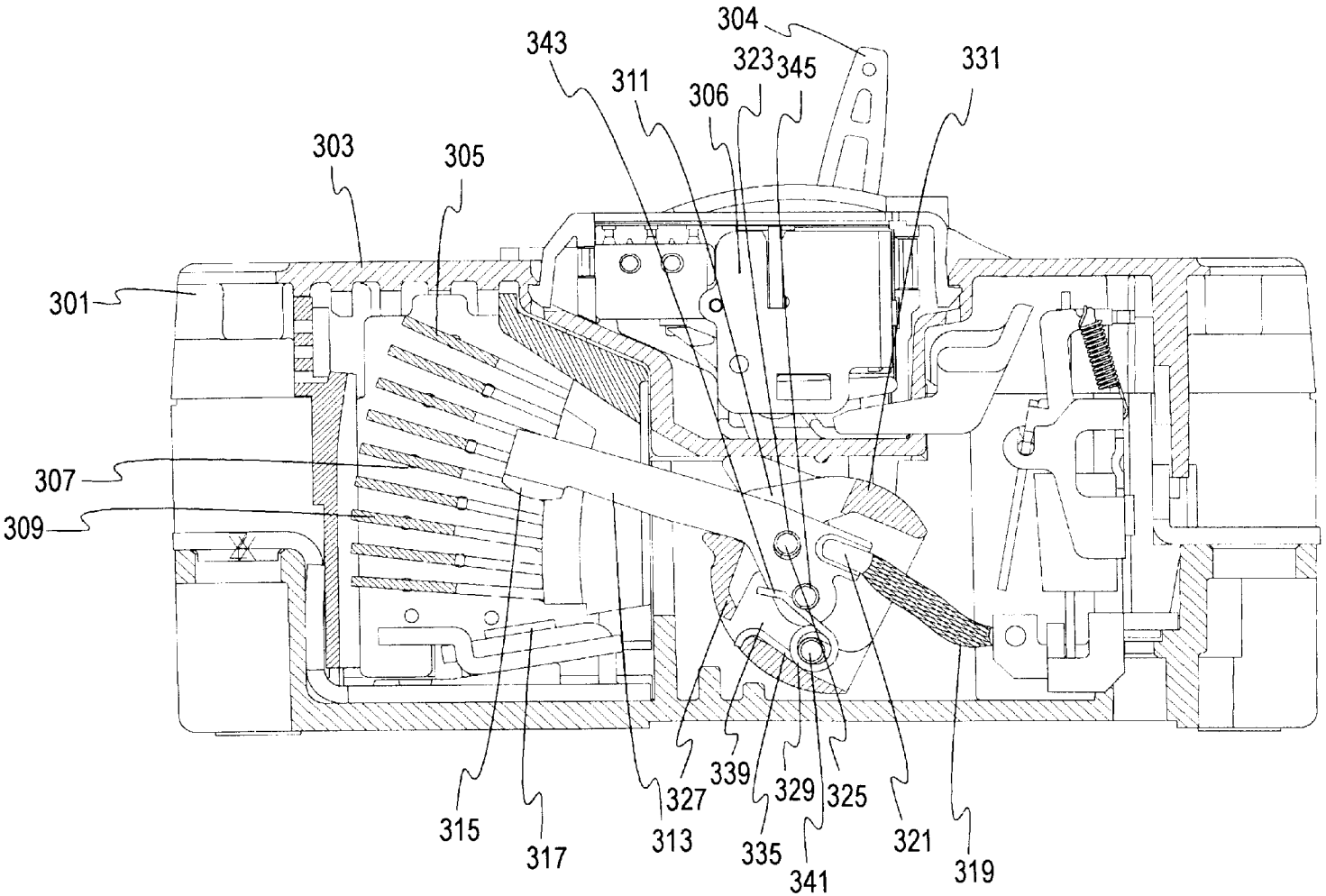
FIG. 2 is a cross-sectional view of the circuit breaker of FIG. 1, shown in the open position.
Figure 3:
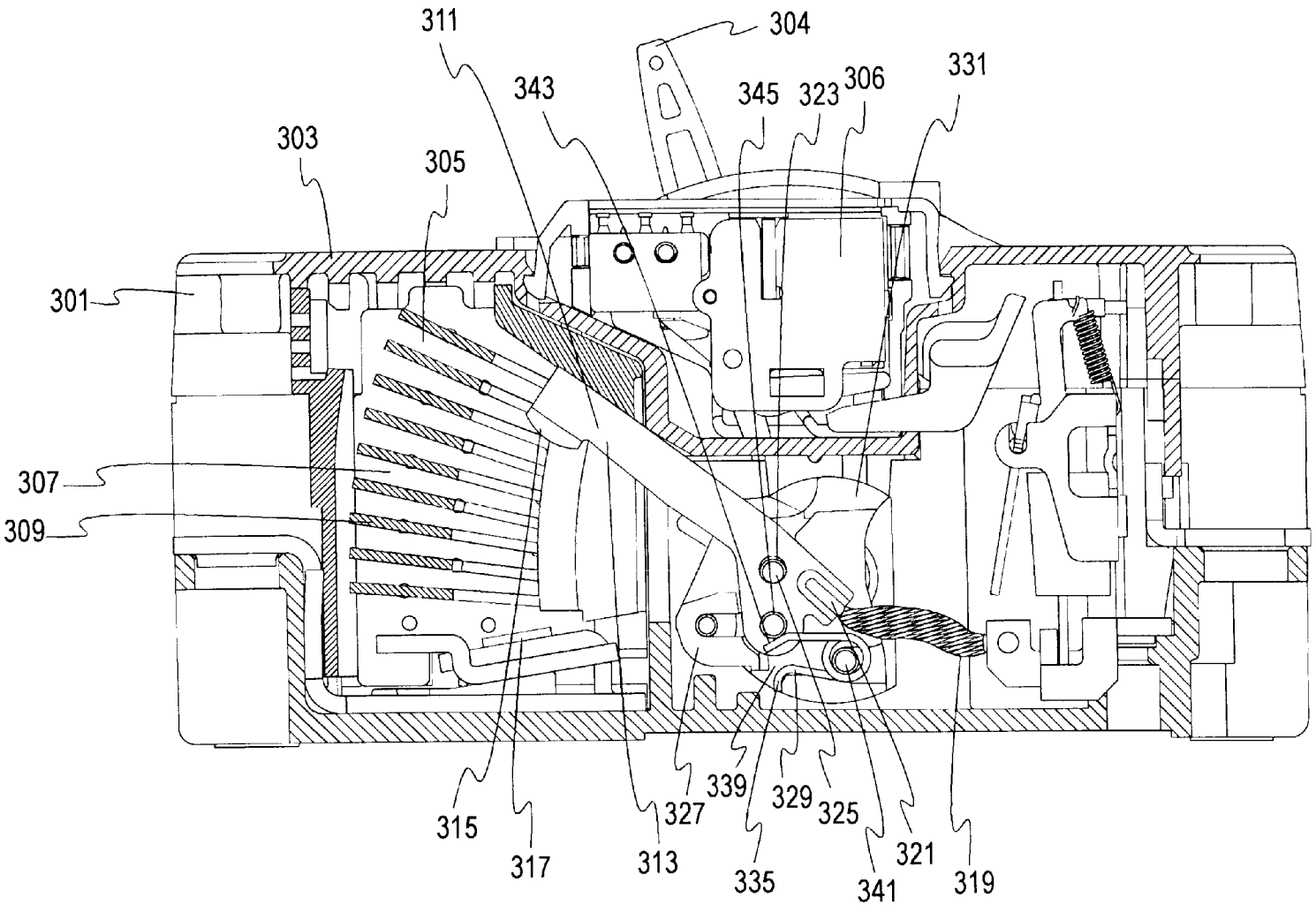
FIG. 3 is a cross-sectional view of the circuit breaker of FIG. 1, shown in the blown-open position.
Figure 4:
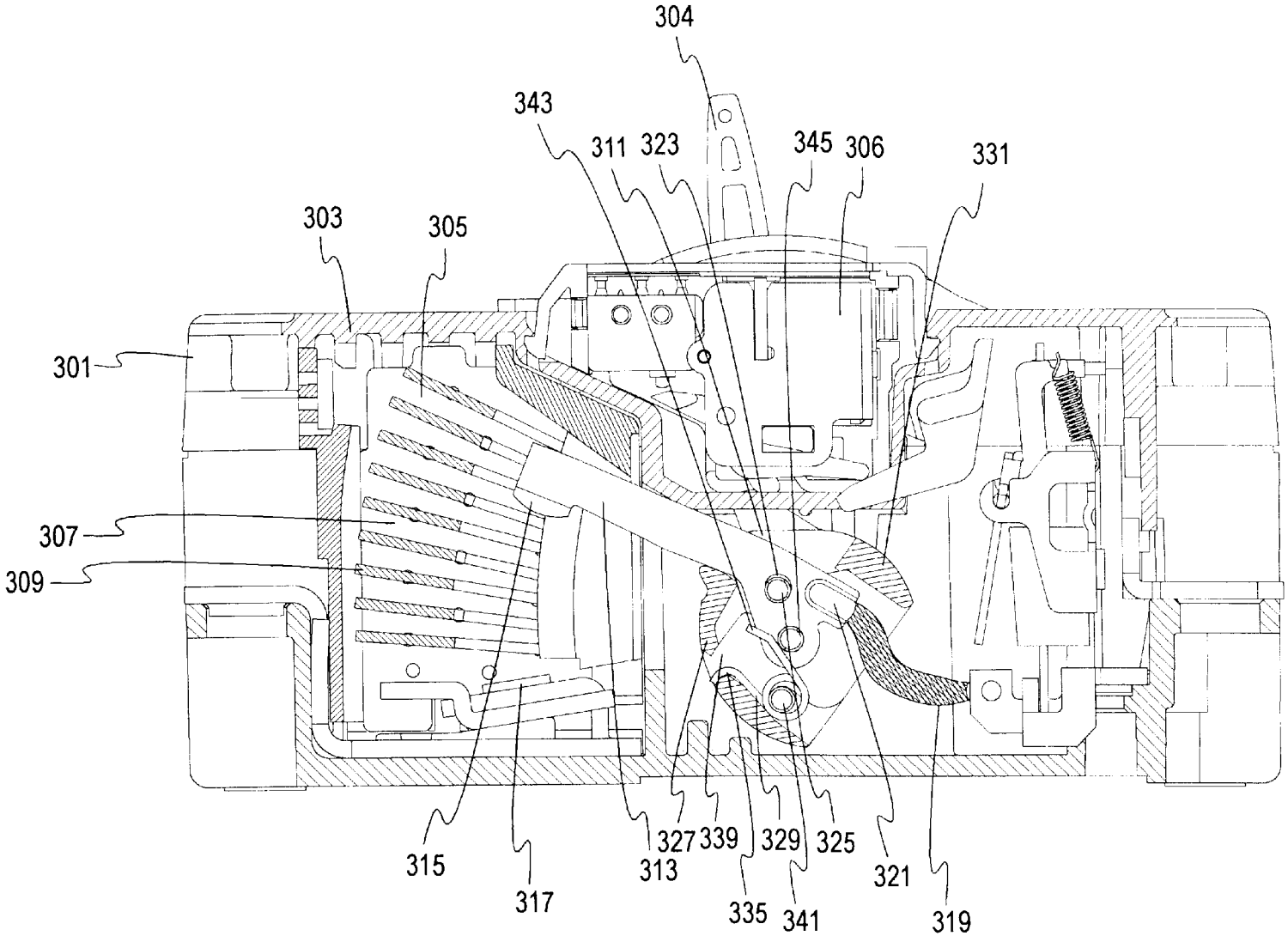
FIG. 4 is a cross-sectional view of the circuit breaker of FIG. 1, shown in the tripped position.

Turning now to the drawings, and referring initially to FIG. 1, the internal components of a circuit breaker 301 are protected by a housing 303. Toward the top of the housing 303, a handle 304 protrudes through a slot in the housing 303 to open and close the contacts of the circuit breaker 301, i.e., to permit resetting of the circuit breaker 301 when it is in a tripped state. This is done by a handle mechanism 306 that connects the handle 304 with a blade assembly 311. Optionally, the handle 304 can be used to visually indicate the status of the circuit breaker 301 by having a legend on the housing 303 near the handle 304 which clearly shows, for example, whether the circuit breaker 301 is ON, OFF, or TRIPPED. The ON setting is a "closed" position, having the contacts closed, as shown in FIG. 1; the OFF setting is an "open" position, having the contacts open, as shown in FIG. 2; and the TRIPPED setting is a "tripped" position, having the contacts open, due to, for example, an undesired overcurrent condition.

An arc extinguisher assembly 305 that includes an arc chute 307 is located near the blade 313. The arc chute 307 contains a plurality of arc chute plates 309 that are positioned parallel to each other and offset by an equal-angular spacing. As is well known in the art, the function of the arc extinguisher assembly 305 is to receive and dissipate electrical arcs that are created upon the separation of the movable contact 315 from the stationary contact 317 of the circuit breaker 301.

Figure 5:
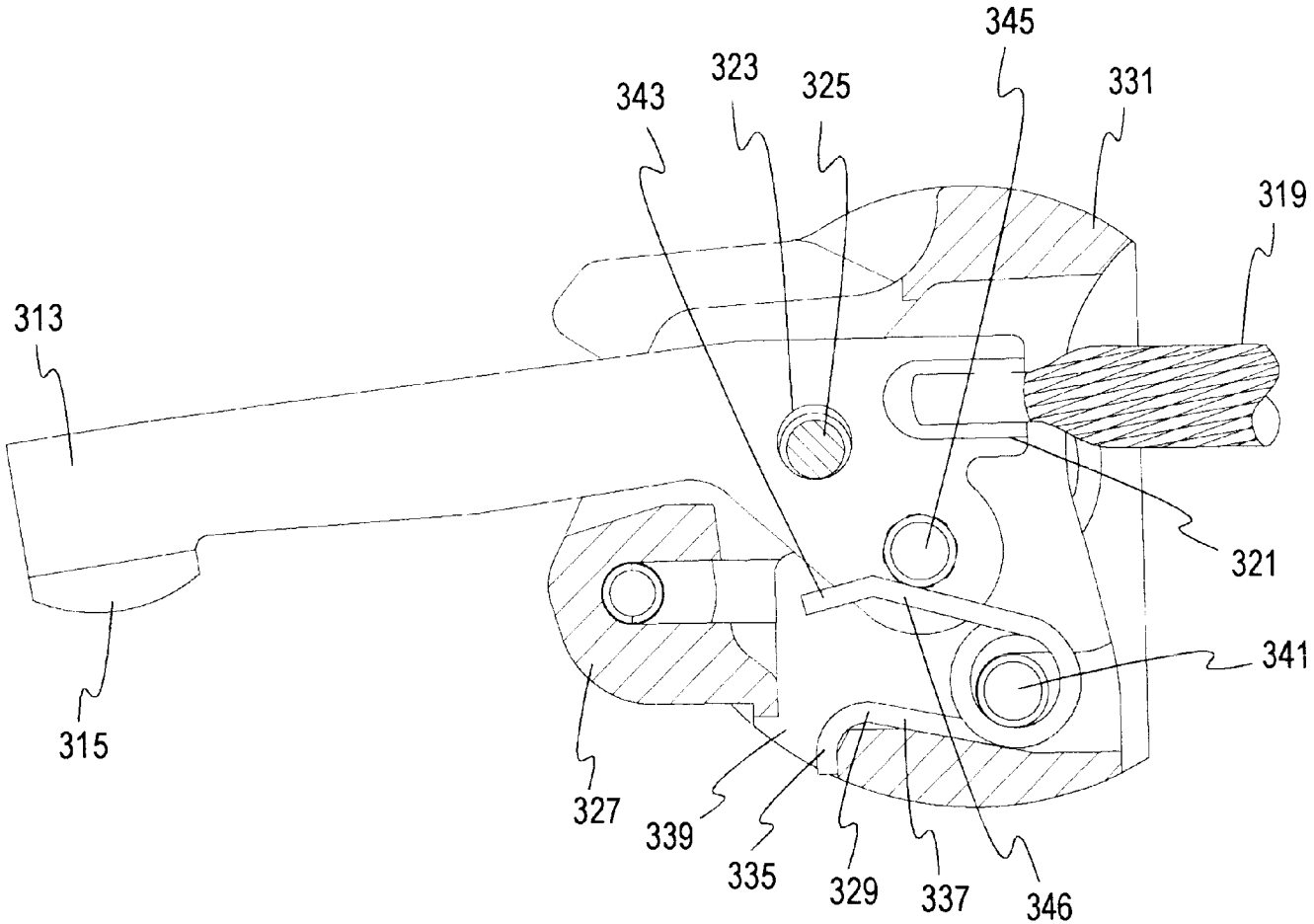
FIG. 5 is a cross-sectional view of the blade assembly in the circuit breaker of FIG. 1, shown in the closed position.
Figure 6:
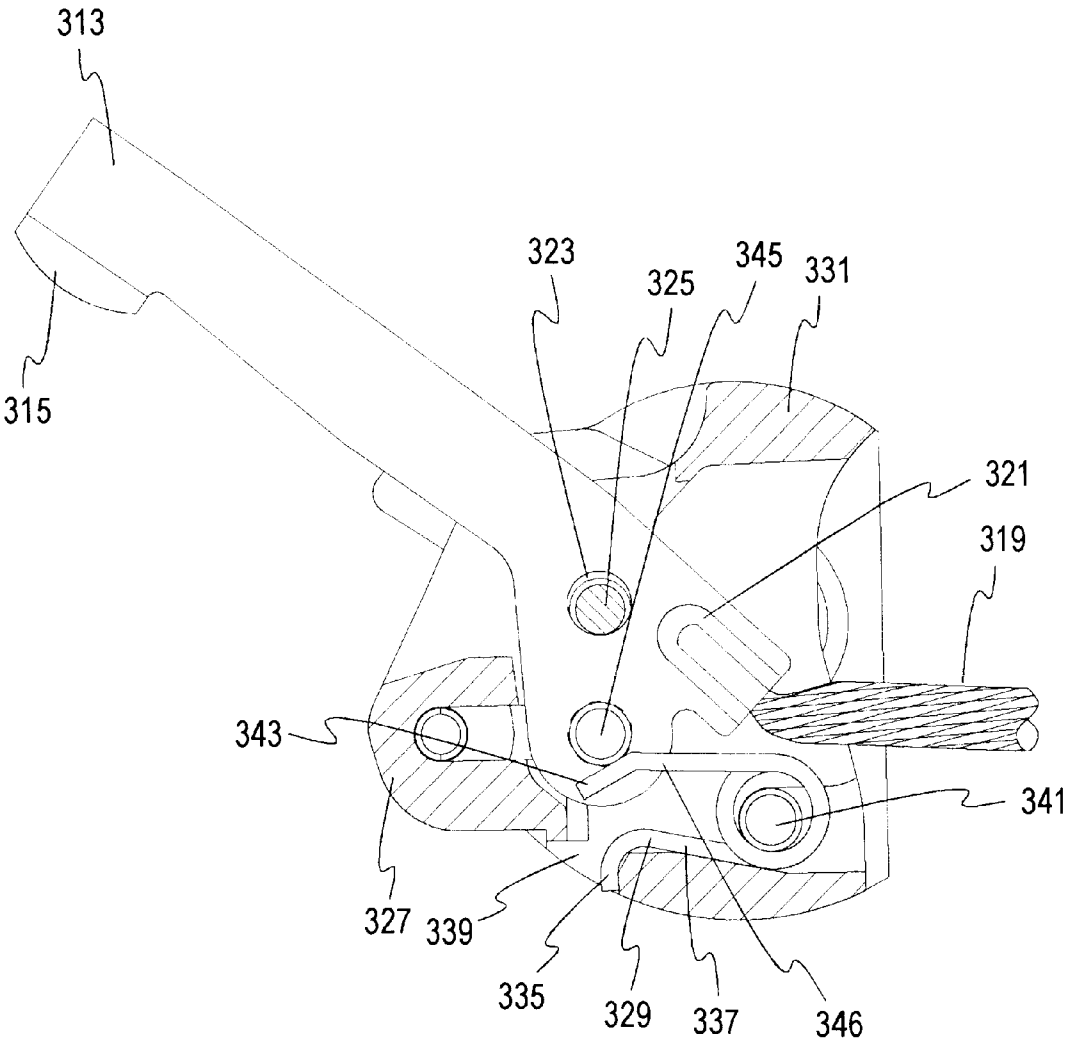
FIG. 6 is a cross-sectional view of the blade assembly of FIG. 5, shown in the blown-open position.
Figure 7:
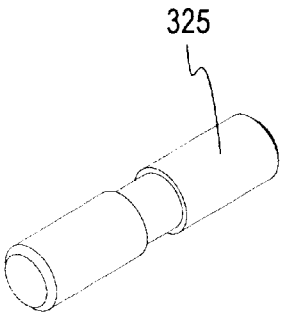
FIG. 7 is an orthogonal view of the blade pivot pin in the circuit breaker of FIG. 1.

The bottom-central part of the circuit breaker 301 is where the blade assembly 311 is located. As shown in FIGS. 5 and 6, the blade assembly 311 contains a blade 313 for each phase that a circuit breaker is designed to handle. For example, a three-pole circuit breaker will contain three blades. At the movable end 315 of the blade 313 the movable contact 315 is attached by connecting means, such as welding. Similarly, a connecting wire 319 is attached to the pivoting end 321. A blade hole 323 located near the pivoting end 321 allows a blade pivot pin 325, shown in FIG. 7, to be inserted in the blade hole 323. The pivot pin 325 allows the blade 313 to have angular motion. Furthermore, the pivot pin 325, which is a solid metal cylinder, has a central recess that is designed to prevent the pin from falling out when the entire blade assembly 311 is assembled. The diameter of the pivot pin 325 is smaller than the diameter of the blade hole 323 to allow the pivot pin 325 to protrude through the blade hole 323, while the length of the pivot pin 325 is long enough to match the width of a shield 327. Given the reduced diameter of the pivot pin 325 and the pressure applied by a pair of blade springs 329, which will be discussed below, the pivot pin 325 will not fall out during the operation of the circuit breaker 301.

Figure 8:
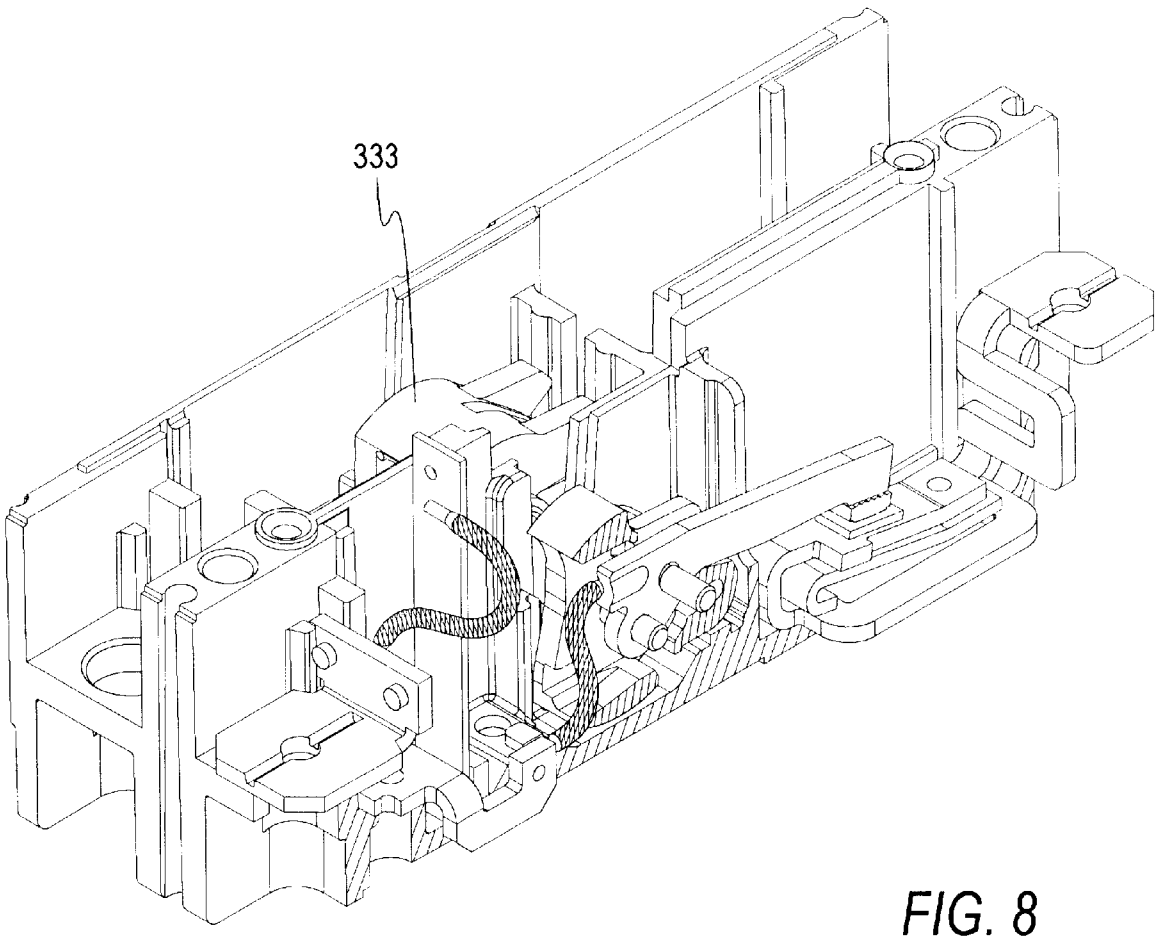
FIG. 8 is a partial perspective view of the circuit breaker of FIG. 1.

The shield 327 is integrated into a blade housing 331, which is a molded plastic part designed to perform at least three functions. First, the blade housing 331 serves a structural function wherein it supports the blade 313 near the pivoting end 321 at the blade hole 323. A slot located on one side of the blade housing 331 allows the blade 313 to swing between the "open," "closed," "blown-open," and "tripped" positions. Second, the blade housing 331 is made as an integrated unit that creates the blade cross bar 333, which connects the blade 313 to another blade 313 if the circuit breaker 301 has more than one phase. For example, if the circuit breaker 301 is a three-pole circuit breaker then the blade cross bar 333, as shown in FIG. 8, is a molded plastic part that has three similar shields connected in parallel to each other, wherein the connections between the shields are part of the molded plastic part. The connections have a tubular shape that spaces the shields according to the required design parameters. Third, the blade housing 331 is designed to protect the blade spring 329 from debris caused by the arcing.

The blade spring 329 is a torsion spring used to perform several functions. Generally, given the tight space in the circuit breaker 301, the blade spring 329 allows a simplified design that meets the required specifications. Specifically, the blade spring 329 performs two major functions serving both as a contact pressure spring and as a latch in the "blown-open" position.

First, the blade spring 329 has a hook 335 formed on the end of a first spring arm 337 that is used to hold the blade spring 329 into place by hooking the spring 329 into a shield recess 339. A spring pin 341 is used to hold the blade spring 329 parallel to an identical second blade spring 329, wherein the pair of blade springs 329 are used to balance and constrain each end of the pivot pin 325 and the spring pin 341. Each end of the spring pin 341 fits into a corresponding spring pin recess formed in the shield 327. Placing the spring hook 335 into the shield recess 339 prevents the spring pin 341 from sliding out of its desired position.

Second, the blade spring 329 has a bend 343, which is located on a second spring arm 346, that increases the negative gradient of the blade spring 329 and that works, given the size, shape, and location of the blade spring 329, to positively hold the blade 313 in the "blown-open" position during a short circuit interruption. A blade lock pin 345 extends from either side of the blade 313, being located approximately in a central position between the pivot pin 325 and the spring pin 341. In the "closed" position the lock pin 345 rests on the second spring arm 346 away from the bend 343 while the torsional force applied by the blade spring 329 forces the blade 313 to stay in the "closed" position. Although the blade spring 329 exerts the least amount of torsional force when the blade 313 is in the "closed" position by having the spring arms 337 and 346 being at a distance farthest from each other, the torsional force increases as the blade 313 is being pushed towards the "open" position by electromagnetic forces. As the blade 313 is being pushed away from the stationary contact 317 the second spring arm 346 rotates, moving towards the first spring arm 337 resulting in a smaller separation between the two spring arms 337 and 346 and, consequently, resulting in a higher torsional force produced by the blade spring 329. Therefore, the highest torsional force applied by the blade spring 329 occurs in the "blown-open" position. When the predetermined threshold for the undesired overcurrent conditions is met the torsional force is completely overcome by the resulting electromagnetic force and the lock pin 345 travels into the bend 343. The result is that the blade 313 snaps into the "blown-open" position.

The bend 343 prevents the lock pin 345 from rolling back towards its location in the "closed" position, effectively latching each lock pin 345. Because the blade spring 329 applies the highest torsional force in the "blown-open" position, the blade 313 requires a much higher force to overcome the latching effect of the bend 343 than to snap into the "blown-open" position. In order for the lock pin 345 to travel back towards its initial position, which occurs in the "closed" position, it must press against the bend 343 until it reaches beyond the sharp turn of the bend 343. The motion of the lock pin 345 presses the second arm spring 346 towards the first arm spring 337 in the direction that the blade spring 329 provides the most resistance. Naturally, a high amount of force is required to move the lock pin 345 beyond the bend 343. After the lock pin 345 is in a location immediately beyond the sharp turn of the bend 343 it is free to travel along the length of the second spring arm 346, stopping in its initial position. Therefore, the natural motion of the second spring arm 345 to snap away from the first spring arm 337 pushes the blade 313 snapping it into the "closed" position.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A circuit breaker for interrupting flow of current upon the detection of excess current or temperature comprising:

a frame having mounted thereon a fixed contact and conductors for establishing an interruptible current flow path thereacross, a blade cross bar mounted on said frame for pivoting movement about a blade cross bar axis, said blade cross bar having a current conducting blade mounted for pivoting movement thereon about a blade axis, said blade having a moveable contact thereon for engaging and disengaging said fixed contact, a blade biasing spring mounted on said blade cross bar for urging said blade away from said fixed contact during open, closed, and tripped operation of said breaker, and latching said blade in an open position upon the occurrence of a blow-open action of said breaker, a spring mounting pin on said blade cross bar, and a spring follower pin mounted on said blade, said blade bias spring being a coiled torsion spring coiled around said spring mounting pin and having a first end leg extending outwardly and cantilevered into contact with said spring follower pin and having a second end leg being bent away from said spring follower pin to define a negative gradient in the spring force exerted between said blade cross bar and said blade during the occurrence of said blow-open action of said circuit breaker.

2. A circuit breaker in accordance with claim 1, further comprising said first end leg having a bend extending towards said second end leg for latching said blade during the occurrence of said blow-open action of said circuit breaker.

3. A circuit breaker in accordance with claim 1, further comprising a hook accommodating opening on said blade cross bar, said torsion spring having said second end leg extending outwardly and formed into a hook anchored in said hook accommodating opening.

4. A circuit breaker in accordance with claim 1, further comprising:

a mounting hole in said blade positioned on said blade axis, and a blade pivot pin passing through said hole for mounting said blade, said blade pivot pin being generally cylindrical and having a center section of reduced diameter establishing shoulders on said pin on both sides of said hole in said blade, whereby upon application of force on said blade by said spring, said blade pivot pin is locked against displacement from said hole.

5. A circuit breaker in accordance with claim 1, further comprising a barrier on said blade cross bar so positioned that upon pivoting movement of said blade cross bar to a tripped, open, or blown-open position, said barrier is interposed between said spring and said fixed contact, thereby protecting said spring from debris generated in the vicinity of said fixed contact.

6. A method for interrupting flow of current in a circuit breaker upon the detection of excess current or temperature comprising:

establishing an interruptible current flow path across said breaker, providing a blade cross bar mounted on a frame for pivoting movement about a blade cross bar axis, said blade cross bar having a current conducting blade mounted for pivoting movement thereon about a blade axis, said blade having a moveable contact thereon for engaging and disengaging said fixed contact, and biasing said blade cross bar to urge said blade away from said fixed contact during open, closed, and tripped operation of said breaker, and latching said blade in an open position upon the occurrence of a blow-open action of said breaker, mounting a spring mounting pin on said blade cross bar, mounting a spring follower pin mounted on said blade, forming a hook accommodating opening on said blade cross bar, and configuring a blade bias spring to be a coiled torsion spring coiled around said spring mounting pin with a first end leg extending outwardly into anchoring engagement with said hook accommodating opening, and with a second end leg extending outwardly and cantilevered into contact with said spring follower pin, said second end being bent away from said spring follower pin to reduce the spring force exerted between said blade cross bar and said blade upon the occurrence of a blow-open action of said circuit breaker.

7. A method in accordance with claim 6, further comprising:

forming a mounting hole in said blade positioned on said blade axis, and installing a blade pivot pin passing through said hole for mounting said blade, said blade pivot pin being generally cylindrical and having a center section of reduced diameter establishing shoulders on said pin on both sides of said hole in said blade, whereby upon application of force on said blade by said spring, said blade pivot pin is locked against displacement from said hole.

8. A method in accordance with claim 6, further providing a barrier on said blade cross bar so positioned that upon pivoting movement of said blade cross bar to a tripped, open, or blown-open position, said barrier becomes interposed between said spring and said fixed contact, thereby protecting said spring from debris generated in the vicinity of said fixed contact.

* * * * *